United States Patent [19]

Pujol et al.

[11] 4,238,533

[45] Dec. 9, 1980

[54] COATING PROCESS AND APPARATUS

[75] Inventors: Jean-Pierre Pujol, Caluire; Jean Jugnet, Beynost; Claude Motta, Pizay, all of France

[73] Assignee: La Cellophane, Paris, France

[21] Appl. No.: 14,219

[22] Filed: Feb. 21, 1979

Related U.S. Application Data

[63] Continuation of Ser. No. 787,587, Apr. 14, 1977, abandoned.

[30] Foreign Application Priority Data

Apr. 16, 1976 [FR] France ..... 76 11302

[51] Int. Cl.[3] ..... B05D 1/40

[52] U.S. Cl. ..... 427/359; 118/118; 118/246; 427/428

[58] Field of Search ..... 427/359, 361, 362, 428; 118/112, 118, 119, 123, 202, 244, 245, 246

[56] References Cited

U.S. PATENT DOCUMENTS

| | | | |
|---|---|---|---|
| 1,213,728 | 1/1917 | Beach | 118/123 X |
| 1,444,217 | 2/1923 | Sparks | 427/428 X |
| 2,229,620 | 1/1941 | Bradner | 118/123 X |
| 2,309,090 | 1/1943 | Bauer et al. | 427/428 X |
| 2,678,284 | 5/1954 | Holt | 118/202 X |
| 3,084,663 | 4/1963 | Warner | 118/119 X |
| 3,186,861 | 6/1965 | Smith et al. | 118/112 X |
| 3,338,736 | 8/1967 | Hain | 427/361 X |
| 3,751,281 | 8/1973 | Peterson et al. | 427/428 |
| 3,844,813 | 10/1974 | Leonard et al. | 118/118 X |
| 3,941,897 | 3/1976 | Vecchia | 118/202 X |

FOREIGN PATENT DOCUMENTS 1475130 3/1967 France .

*Primary Examiner*—Shrive P. Beck

*Attorney, Agent, or Firm*—Sherman & Shalloway

[57] ABSTRACT

Films having widths of up to one meter or more can be coated at high coating speeds of up to 400 meters per minute or more with coating compositions having viscosities reaching up to 400 centipoises or more by arranging first and second guide rollers, a coating roller and rotating smoothing rod such that the path of travel of the film during the coating procedure is a substantially circular path whose diameter is preferably about one meter. During the coating procedure, the tension of the film by the first and second guide rollers is regulated independently of the speed at which the film travels. The apparatus and process have applicability to a wide range of films and coating compositions.

6 Claims, 2 Drawing Figures

COATING PROCESS AND APPARATUS

This is a continuation of application Ser. No. 787,587 filed Apr. 14, 1977, now abandoned.

BACKGROUND OF THE INVENTION

1. Field of the Invention

The present invention relates to a process for coating a film with a thin smooth coating layer wherein the coating material is first deposited on the film with a coating roller and then regularly distributed and smoothed over the surface of the film to provide a thin uniform coating layer. The invention also relates to a device for carrying out this process.

2. Description of the Prior Art

In one known type of process for applying coatings, a large-diameter coating roller applies a rough and relatively thick layer of the coating on the film and this layer is subsequently evenly distributed and proportioned with a sheet of air to provide a relatively thin and smooth coating layer.

However, this class of coating technique cannot be used for coating at high speeds with emulsions or solutions having viscosities in excess of about 100 centipoises because of the mechanical restraints caused by the very considerable disturbance of the coating during the smoothing procedure. Moreover, when applied to specific applications, such as coating of polyvinylidene chloride on a polyester film, smoothing of the coating at high speeds with a sheet of air gives the coating "an orange skin" appearance and creates inclusions of air which impair the impermeability of the coating.

French Pat. No. 1,475,130 describes a process for coating a film utilizing a large-diameter roller with smoothing of the coating perfected using a rotating rod of much smaller diameter.

However, this process has been only marginally successful, if at all, for coating porous supports such as paper, but has not been at all successful in high-speed coating applications and particularly with respect to plastic films having a width of at least one meter. Moreover, this technique results in a "screen effect" on the coated film due to the irregularity of the coating and, accordingly, this process has not been acceptable for a majority of the applications to which coated films are utilized.

SUMMARY OF THE INVENTION

The present invention provides a process and apparatus for overcoming the drawbacks of the prior art. Basically. the present invention utilizes a large-diameter coating roller and smaller-diameter rotating smoothing rod as in the abovementioned French patent, but modifies the French patent process and apparatus by providing the coating roller and smoothing rod in such arrangement that the film follows a circular path during the entire coating operation while the tension to which the film is subjected during coating is adjustable, independently of the moving speed of the film. The coating apparatus for carrying out the process of the present invention comprises first and second guide rollers, a rotating smoothing rod and a coating roller, each of these elements being arranged such that their peripheral portions, over which the film travels, defines a substantially circular path, the apparatus further comprising means for regulating the tension to which the film is subjected between the first and second guide rollers.

It was surprisingly found that by causing the film to travel a substantially circular path during coating and smoothing of the coating on the film surface while regulating the tension of the film during the coating and smoothing operation, it becomes possible to reach coating speeds of up to 400 meters per minute with viscosity of the coating solution or emulsion reaching up to 400 centipoises and to apply coatings to films having width greater than 1 meter at these high speeds and with such viscous coatings.

It is therefore an object of the present invention to provide a coating process and apparatus for applying uniformly smooth and relatively thin coatings on a moving film.

It is a further object of the present invention to provide a coating process and apparatus which are applicable to a wide variety of coatings, compositions and film materials.

It is a still further object of the coating process and apparatus of the present invention to allow coating to be accomplished at high rates of speed with coating compositions which can have relatively high viscosities on films which can be relatively wide.

These and other objects and advantages of the process and apparatus of the present invention will become more apparent from the following detailed description in which reference will be made to the accompanying drawings in which:

FIG. 1 is a schematic illustration of one embodiment for carrying out the present invention; and FIG. 2 is a schematic illustration on an enlarged scale of an embodiment for carrying out the present invention.

DETAILED DESCRIPTION OF THE INVENTION AND PREFERRED EMBODIMENTS

Figure 1:
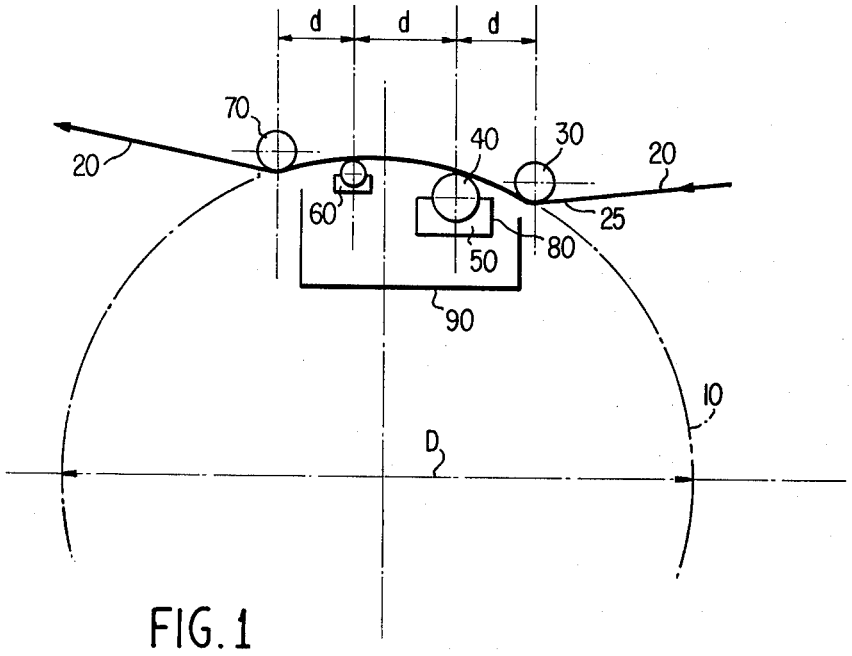

As seen in FIG. 1, the film 20, traveling in the direction of the arrow, passes underneath a first guide roller 30, then to the coating roller 40 which picks up the coating composition 50 contained in the vat 80 and deposits the coating composition on the surface 25. The film continues its path of travel over the rotating smoothing or scraper rod 60 which scrapes off excess coating material and forms a relatively smooth and uniformly thin coating layer on the surface 25 of the film 20. The path of the film continues past the second guide roller 70. The film path between the first guide roller 30 and second guide roller 70 is a substantially circular path 10 having diameter D. The respective distances between the guide roller 30, coating roller 40, rotating smoothing rod 6 and guide roller 70 are preferably substantially equal, of distance d, as measured by a vertical plane passing through the respective axes of the elements. The distance d is preferably less than or equal to 20 centimeters while the diameter D is generally between 0.50 and 1.50 meters, but more preferably is substantially about 1 meter. A recovery vat 90 is provided to recover the coating removed from the film by the rotating smoothing rod 60.

Any type of film can be coated by the process and with the apparatus of the present invention so long as the film is sufficiently flexible to be able to travel over a circular path as defined herein without breakage. Accordingly, both thermoplastic and thermosetting films, as well as non-oriented, mono-oriented or bi-oriented plastic films can be used Cellulose films, paper, metal foils and the like can also be coated according to the present invention. Furthermore, the thickness of the film to be coated is not at all critical but generally will be less than 10 mils (0.010 inches). Similarly, the thickness of the coated film is not particularly critical and generally can vary between about 8 to about 200 microns. The rate at which the coating is applied to the film is also not particularly critical but will vary according to the type and composition of the coating, the type of film and the intended end use. Generally, the coating will be applied at a rate sufficient to provide a deposited weight of the coating, after being smoothed and evened by the rotating smoothing rod, between about 0.01 to about 20 grams per square meter on a dry material basis.

Similarly, any type of coating compostion, including solutions, emulsions, dispersions, fluid resins and the like, can be used in the present invention. For example, matting solutions, aqueous emulsions of polyvinylidene chloride and other resins, anti-static aqueous emulsion, diazo solutions, adhesive acrylic solutions, and the like, can be coated onto films according to the present invention.

The film 20 from any suitable source (not shown in the figures) such as storage supply reel, directly from the manufacturing process or after a preliminary treatment is fed to the guide roller 30 by any conventional means well known in the art.

The coating apparatus also includes means for regulating the tension to which the film is subjected between the first guide roller 30 and second guide roller 70. The tension regulating means can be any means well known for regulating the tension of a film traveling between two guide rollers. The degree of tension can be selected within broad limits so long as their will be no slippage or sagging of the film during the coating process which would impair the application of a smooth coating. The upper limit of the amount of tension which will be applied will be less than the elastic limit of the film being coated.

Figure 2:
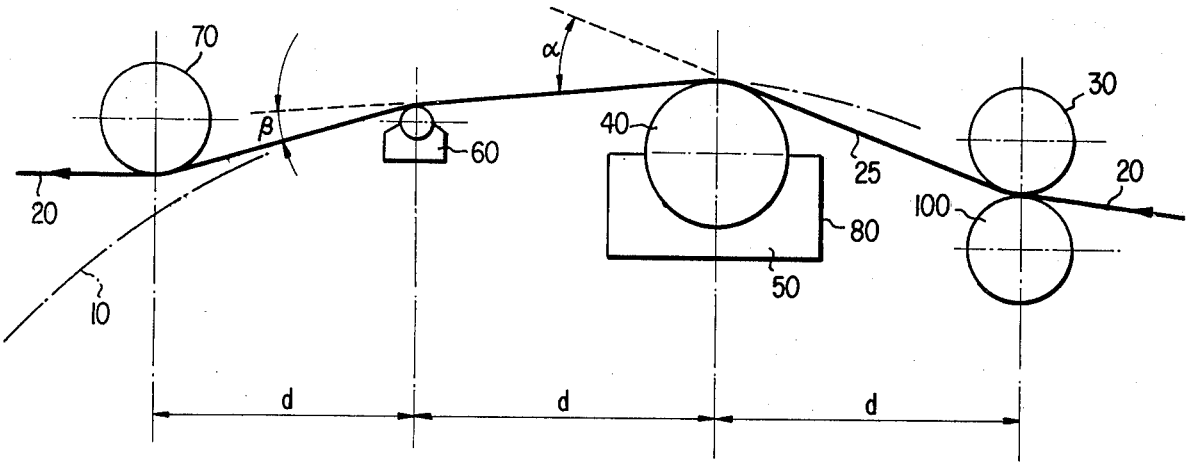

As one example of the means suitable for applying tension to the traveling film 20, there can be used a counter-roller such as the roller 100 shown in FIG. 2 on the other side of the film 20 in relation to the guide roller 30. By adjusting the force exerted on the film by the guide roller 30 and counter-roller 100, the latter, for example, being stationary while the former being driven, it is possible to isolate the upstream and downstream tensions on the film.

The tension on the film can also be adjusted and controlled by utilizing as one of the guide rollers, particularly the second guide roller 70, a "vacuum roll", i.e. a hollow roller having numerous perforations in its walls and in which a partial vacuum is created with a suction device to hold the film flat against its surface. It is also possible to use electrostatic flattening of a film on a drum such as described, for example, in French Pat. No. 1,573,132.

The tension to which the film is subjected during the coating process, i.e. at least that portion of the path of the film between the coating roller and rotating smoothing rod, can be adjusted, independently of the speed at which the film is coated. The tension can generally vary between above 0 to about 60 kg/linear meter of film width. In practice, and as previously noted, the tension to which the film is subjected for coating purposes is regulated between the first and second guide rollers.

In a preferred arrangement of the coating apparatus, the coating roller has a diameter less than 10 cm, the axes of the coating roller, guide rollers and rotating smoothing rod are in vertical planes, at most 20 cm apart, and the diameter of the substantially circular path followed by the film is approximately equal to one meter.

The coating apparatus is very compact because of the relatively small diameter of the coating roller and the relatively short length of the path of the film between the two guide rollers. These features, coupled with the associated means for regulating the tension of the film between the guide rollers provides very advantageous results in the coating process with respect to the ability to operate at high coating speeds with films of large widths and with coatings of high viscosities. Furthermore, an additional advantage of the process and apparatus of the present invention is that it becomes possible to coat films with low modulus of elasticity, such as cast Polypropylene which were practically impossible with conventional methods and apparatus.

While the coating roller generally has a maximum diameter of about 10 cm, its minimum diameter is generally about 4 cm. For any particular length of the coating roller, the diameter should, of course, be selected to avoid the risk of sagging. The same applies, of course, to the guide rollers and rotating smoothing rod. The rollers and rotating rod can be formed from any metallic or other materials having sufficient mechanical strength.

Any conventional coating roller can be used in the apparatus of the present invention. The roller can be smooth or can be in the form of a screw which acts as a volumetric pump. By selecting the peripheral speed of the roller and the depth of the screw engravings, the amount of coating deposited on the film can be readily determined. Preferably, the amount of coating deposited on the film will be at most five times and at least 2 times the final amount of the desired final coating in order to prevent mechanical shearing of the coating by the rotating smoothing rod. Actually, it has been found that the small diameter of the coating roller accents the regularity and stability of the coating.

In a preferred embodiment of the present invention, the coating roller is covered with an insulating material such as ceramic while a cooling fluid circulates on the inside of the roller. Generally, a fluid having a temperature between about 3° and 6° C. is utilized. This makes it possible to avoid sticking and coalescence of the coatings. All types of ceramics or other materials having similar surface properties and temperature resistance can be used for this purpose. The thickness of the ceramic layer is generally in the range of from about 0.04 to about 0.10 mm. The cooling fluid can be water or any other fluid having the required thermal properties. It is also possible to utilize a cooling fluid applied externally to the coating roller. In this case, the cooling fluid is advantageously the same as the solvent used in forming the coating composition.

The preferred form of the rotating smoothing rod for proportioning and smoothing the coating applied by the coating roller is that described in the aforementioned French Pat. No. 1,475,130, particularly the embodiment illustrated in FIG. 1 and the corresponding description. The rotating smoothing rod is provided with a smooth outer surface and should preferably be supported along its entire length to assure good contact with the film. The rod will preferably have as small a diamater as possible and preferably between about 8 to about 16 mm. Moreover, it is also preferred to provide the smoothing rod with a thin layer of ceramic or similar insulating material and an internal and/or external cooling fluid circulation system sufficient to keep the surface temperature of the smoothing rod between about 2° C. to about 6° C.

It is, of course, possible to use any other type of smoothing rod conventionally used in the coating art to obtain substantially the same results.

The guide rollers are also conventional and any known type of guide rollers can be used. The outside diameter of guide roller 30 and guide roller 70 are preferably the same but may be different. The diameter is generally in the range of from about 10 to about 25 cm.

In the specific embodiments illustrated in FIG. 2, the distance d is equal to about 15 cm, while the angles $\alpha$ and $\beta$ vary respectively between about 17° and 20°. The angle that the film makes with itself before and after passage over the coating roller, on the one hand, and before and after passage over the smoothing rod, on the other hand, is therefore between about 160° to about 163°.

Roller 40 is engraved helicoidally (not shown in the figure) with a diameter of about 60 mm, and is interiorly cooled. The rotating smoothing rod 60 has a diameter of about 12 mm and is cooled both interiorly and exteriorly.

The tension regulating means is provided by the counter-roller 100 having diameter approximately equal to that of the coating roller 30 and by the guide roller 70 of the "vacuum roll" type (to simplify the figure, the suction device which creates the partial vacuum in this hollow roller has not been shown).

Rollers 30 and 70 are driven respectively by independent motors (not shown in the figure), the peripheral speed of the surface of the rollers being determined to drive the film through the coating operation at the desired speed.

In the operation of the apparatus as illustrated in FIG. 2, the rollers 30 and 70 are initially driven at the same peripheral speed by any suitable and conventional control device such as electronic controls. Thereafter, the counter-roller 100 is adjusted either by mechanical means or electronic means, until the pressure between the roller 30 and roller 100 is such that the tension to which the film is subjected before passage between the rollers is independent of the tension to which the film is subjected after passage of the film between these rollers. The pressure regulation can be accomplished by any conventional means well known in the art. The counter-roller 100 is driven in rotation by the guide roller 30 through the film 20.

After the speed of the film and the rollers has been initially stabilized, the tension to which the film is subjected between the guide rollers 30 and 70 is substantially zero. Thereafter, the speed of rotation of the periphery of the guide roller 70, in relation to the rotational speed of the periphery of the guide roller 30, is increased to subject the film located between the two guide rollers to the desired tension. Tension measurements can be performed by any suitable and conventional tension measuring devices placed along the path of the film.

The coating roller 40 and the smoothing rod 60 can be cooled by any conventional cooling means either internally or externally or both.

According to the present invention, coating operations can be performed with a wide range of coating compositions and coating viscosities and amount of coating composition deposited on the supporting film and with coating speeds varying from as little as 10 meters per minute to as much as 400 meters per minute or more, depending on the thickness of the support film and the amount of coating material deposited. Typical applications of the coating process and apparatus of the present invention include the following list which is considered to be merely representative and in no manner limiting:

barrier products and sealing layers for food films and paper
matting varnish or printable varnish for the graphic arts industry
matting varnish + diazo varnish for diazo drawing film
colored varnish for coating of films intended for the textile industry
diazo varnish on paper
anchoring layers for film intended to be supercoated in the graphic arts field
acrylic varnishes (2 to 8 g/m$^2$) on polyethylene or polypropylene film for adhesive use or peel-off film
antistatic varnish (0.01 to 0.02 g/m$^2$ of dry product)
PVCD (1 to 10 g/m$^2$) on retractable plastic film.

EXAMPLE 1

Using the apparatus illustrated in FIG. 2, a polyester film of 12 microns thickness was coated with an emulsion of polyvinylidene chloride containing 35% by weight solids. The film speed was set at 300 meters per minute and the emulsion was deposited at a rate of 3 g/m$^2$ on a dry material basis. The polyester film was maintained at a tension of approximately 24 kg/linear meter of film width between the guide rollers. The coated film was free from defects resulting from grains or air bubbles.

The same results were obtained when a polypropylene film, 12 microns thick, was substituted for the polyester film.

width of the film—1 m.
viscosity of the emulsion—5 to 10 cp.

EXAMPLE 2

Again utilizing the apparatus illustrated in FIG. 2, a polyester film, 75 microns thick, was coated at a rate of 150 meters per minute with a pigmented varnish in an aqueous alcohol medium, containing 10% dry extract. The coating was applied to provide 9 g/m$^2$ on a dry weight basis of the coating. The tension between the guide rollers was about 40 kg/linear meter of film width. The resulting film had an excellent appearance free of defects and was suitable for use in the field of graphic arts.

width of the film 1 m.
viscosity of varnish 300 cp.

EXAMPLE 3

Utilizing the device illustrated in FIG. 2, a cellulose film which had previously been coated with polyvinylidene chloride in a solvent medium was given a supercoating with an aqueous emulsion of polyvinylidene chloride containing 40% dry material. Coating was performed at 300 m/minute and the coating was deposited to provide a dry weight of 6 g/m$^2$. During the coating operation, the tension between the guide rollers was maintained at about 32 kg/linear meter of the film width. The resulting coating film had a defect free appearance and was substantially impermeable.

width of the film—1 m.
viscosity of emulsion—5 to 10 cp.

What is claimed is:

1. In a process for coating a flexible polyester film with a coating composition having a predetermined thickness, by the steps of:

feeding the uncoated polyester film over a coating roller which deposits a layer of the coating compositions on a surface of the polyester film, the layer being thicker than the predetermined thickness, and feeding the coated polyester film over a rotating smoothing rod having a diameter less than the diameter of the coating roller to smooth out and reduce the thickness of the coating to the predetermined thickness, the improvement comprising feeding the polyester film, in at least its path of travel between the coating roller and rotating smoothing rod, over a substantially circular path of travel having a diameter between 0.5 and 1.5 meters, while maintaining the polyester film under tension during at least its travel in the substantially circular path, the tension being maintained independently of the speed of travel of the polyester film in the substantially circular path and passing the polyester film over the coating roller and over the rotating smoothing rod such that the angle that the polyester film makes with itself before and after passage over the coating roller and before and after passage over the rotating smoothing rod is between about 160° and about 163° with the proviso that the axes of the coating roller and rotating smoothing rod are in vertical planes which are at most 20 centimeters apart.

2. The process of claim 1 wherein the flexible polyester film has a width of at least 1 meter.

3. The process of claim 1 wherein the flexible polyester film has a width of about 2 meters.

4. The process of claim 1 wherein the speed of travel of the film in the substantially circular path ranges from about 10 meters per minute to about 400 meters per minute.

5. The process according to claim 4 wherein the speed of coating is about 300 meters per minute.

6. The process of claim 1 wherein the coating composition comprises an aqueous emulsion of polyvinylidene chloride.

* * * * *